US009413106B2

(12) United States Patent
See et al.

(10) Patent No.: US 9,413,106 B2
(45) Date of Patent: Aug. 9, 2016

(54) POSITIVE LOCK CONNECTOR FOR SMALL POWER COUPLERS

(71) Applicant: VOLEX PLC, London (GB)

(72) Inventors: Yun Jaan See, Singapore (SG); Mui Lian Jessica Toh, Singapore (SG)

(73) Assignee: Volex plc, London (GB)

( * ) Notice: Subject to any disclaimer, the term of this patent is extended or adjusted under 35 U.S.C. 154(b) by 0 days.

(21) Appl. No.: 14/517,681

(22) Filed: Oct. 17, 2014

(65) Prior Publication Data

US 2015/0104967 A1 Apr. 16, 2015

Related U.S. Application Data

(60) Provisional application No. 61/890,816, filed on Oct. 14, 2013.

(51) Int. Cl.
*H01R 13/627* (2006.01)

(52) U.S. Cl.
CPC ..... *H01R 13/6275* (2013.01)

(58) Field of Classification Search
CPC ..... H01R 13/627; H01R 13/6275; H01R 13/6278; H01R 13/639; H01R 13/6271; H01R 13/6276; H01R 13/6277; G02B 6/3893; G02B 6/3825
USPC ..... 439/345, 131, 157, 352–358, 385, 174, 439/300, 625, 626, 638, 901, 903–905, 928, 439/928.1; 385/53
See application file for complete search history.

(56) References Cited

U.S. PATENT DOCUMENTS

| | | | | |
|---|---|---|---|---|
| 6,641,424 | B1 * | 11/2003 | Hanak | H01R 13/639 439/352 |
| 6,821,024 | B2 * | 11/2004 | Bates, III | G02B 6/3893 385/76 |
| 6,939,161 | B1 * | 9/2005 | Yi | H01R 13/6395 439/373 |
| 7,077,698 | B2 * | 7/2006 | Matthys | H01R 13/745 439/369 |
| 7,381,078 | B2 * | 6/2008 | Mtchedlishvili | H01R 13/5221 439/352 |
| 7,686,638 | B2 * | 3/2010 | Boyd | H01R 13/6272 439/344 |
| 7,841,888 | B2 * | 11/2010 | Xia | H01R 13/6395 439/354 |
| 2011/0080008 | A1 * | 4/2011 | Teo | H01R 13/6272 292/197 |
| 2011/0256750 | A1 * | 10/2011 | Chen | H01R 13/506 439/345 |

* cited by examiner

*Primary Examiner* — Amy Cohen Johnson
*Assistant Examiner* — Oscar C Jimenez
(74) *Attorney, Agent, or Firm* — Baker & Hostetler LLP

(57) ABSTRACT

A coupler including a housing is configured to affix individual lines of a multiline cable within the housing, the housing including a front portion for engaging an inlet, a rear portion, and an upper portion including a raised central area and at least one lowered side area. A sliding lock including a lock housing is configured to slide over the raised central area and the at least one lowered side area and at least one spring arm affixed to the lock housing; and an outer mold configured to engage the rear portion of the housing and constrain the sliding lock within a gap formed between the housing and the outer mold. The sliding lock is configured to slide forward within the gap to engage the inlet and lock the sliding lock in place, thereby locking the connector to the inlet, and slide backward within the gap and disengage the inlet.

14 Claims, 10 Drawing Sheets

POSITIVE LOCK CONNECTOR FOR SMALL POWER COUPLERS

CROSS REFERENCE TO RELATED APPLICATIONS

This application claims benefit under 35 U.S.C. §119(e) of Provisional U.S. patent application No. 61/890,816, filed Oct. 14, 2013, the contents of which is incorporated herein by reference in its entirety.

TECHNICAL FIELD

The present disclosure relates to couplers for providing an electrical power connection.

BACKGROUND

An electrical power connector is used to attach an electronic device, such as an appliance or other powered device, to its power source via an inlet. Conventional electrical connectors have electrically conductive terminals connected to a power cable and fixed together in a housing. When in use, the electrical connector is engaged with an inlet for the electronic device, which is mounted on or within the device so as to supply electrical power to the device. The combination of the connector and the inlet is referred to as a coupler. The conventional electrical connector is readily detachable from the inlet.

Users encounter difficulties when using conventional electrical connectors as the connector may be too readily detached from the inlet. Laptop computer users, for example, often are required to sit in a location that is not close to a power outlet so the cord from the power connector stretches across an area where people may be passing, resulting in the cord being stepped upon and the cord being caught by people's feet or other objects, resulting in the electrical power connector being pulled from the laptop. While the other end of the cable to the electrical power connector could also be pulled from a wall outlet, the wall outlet connection is usually more resistive to detachment so the laptop connection is usually detached first. Similar problems occur when other electrical device inlets are connected to an electrical power connector that is not capable of being locked to the electrical device inlet. However, it is not always desirable to have the electrical power connector locked to the inlet as the electrical device may be damaged if the cord is pulled hard while the connector is locked to the inlet.

It is therefore desirable to provide an improved coupler that enables the electrical power connector to be selectively locked to the inlet of the electrical device.

SUMMARY

The present disclosure aims at overcoming the weaknesses of conventional connectors and providing an electrical power connector with positive locking connector suitable for small power connectors.

A coupler according to embodiments of the present disclosure includes a housing configured to affix individual lines of a multiline cable within the housing, the housing including a front portion for engaging an inlet, a rear portion, and an upper portion including a raised central area and at least one lowered side area; a sliding lock including a lock housing configured to slide over the raised central area and the at least one lowered side area and at least one spring arm affixed to the lock housing; and an outer mold configured to engage the rear portion of the housing and constrain the sliding lock within a gap formed between the housing and the outer mold; wherein the inlet includes an inlet housing having a front face and forming an interior cavity behind the front face, the interior cavity forming an interior wall within the interior cavity, wherein the inlet housing further forms at least one opening within the front face for receiving the at least one spring arm, wherein the sliding lock is configured to slide forward within the gap to engage the opening of the inlet and lock the sliding lock in place, thereby locking the connector to the inlet, and slide backward within the gap and disengage the inlet.

BRIEF DESCRIPTION OF THE DRAWINGS

Embodiments of the present disclosure will be described more fully hereinafter with reference to the accompanying drawings, in which.

DETAILED DESCRIPTION OF ILLUSTRATIVE EMBODIMENTS

Figure 1:
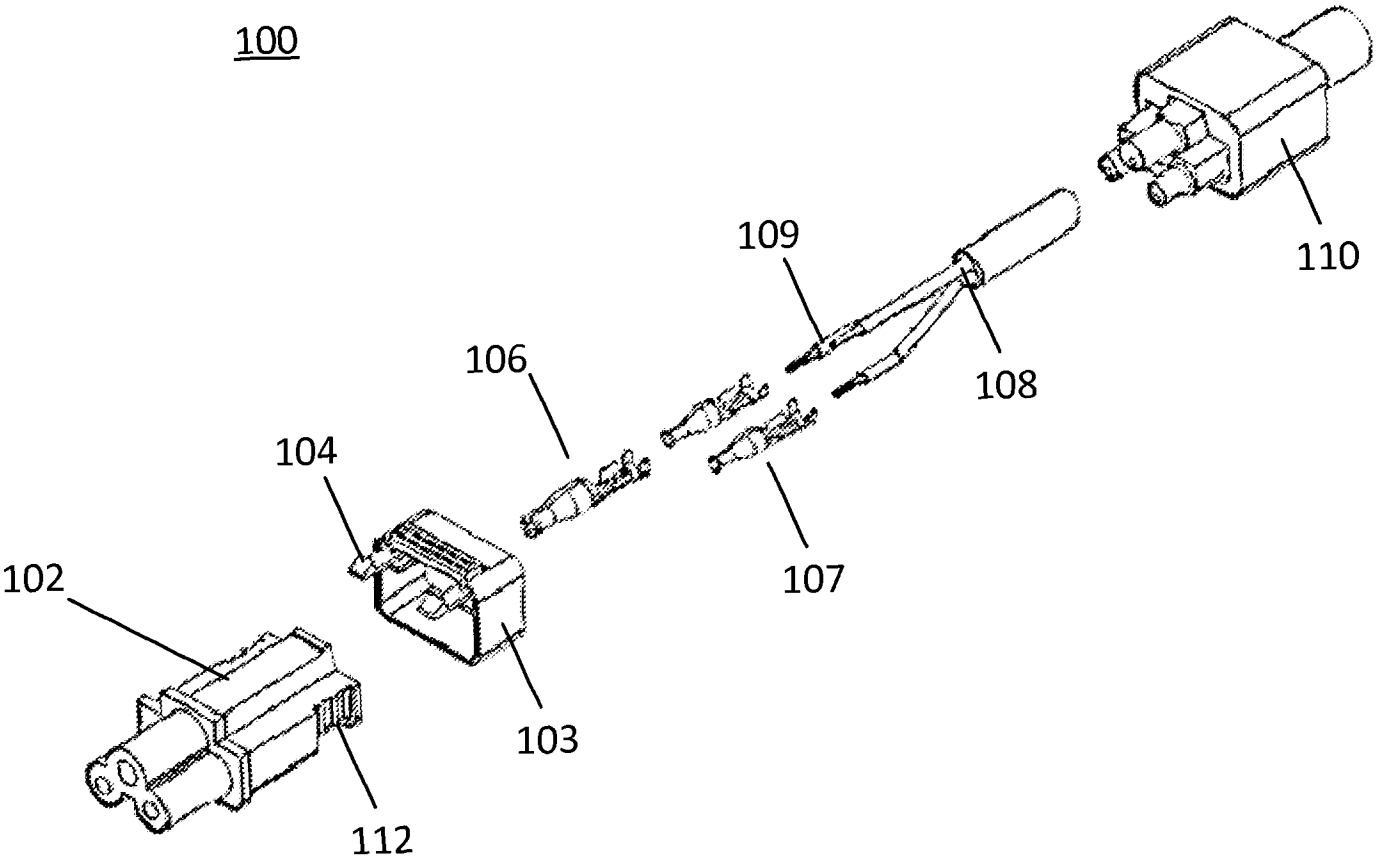
FIG. 1 is an exploded view showing an electrical connector of the present disclosure.

While embodiments of an electrical power connector, for convenience and simplicity, are illustrated in the drawings and described herein, it is to be understood that the present disclosure is not limited to electrical power connectors and could equally apply to any type of connector, including data and signal connectors and non-electrical connectors, such as optical connectors.

An exploded view of an electrical connector 100 of the present disclosure is illustrated in FIG. 1. The electrical connector 100 is illustrated as a C5 type of connector, as defined by the International Electrotechnical Commission (IEC) 60320 standard for non-locking appliance couplers and interconnector couplers for the connection of powers supply cords to electrical appliances up to 250 volts. C5/C6 connectors have a unique clover-leaf or Mickey Mouse head shape and are frequently used for many small switched-mode power supplies that are used for computer laptops. IEC 60320 couplers are identified with the letter C, with a first number corresponding to the electrical connector and a second number, one number higher than the first, corresponding to the inlet. Hence, a C5 connector would only connect to a C6 inlet. While the present disclosure is illustrated for a C5/C6 appliance coupler, the present disclosure equally applies to C1/C2, C3/C4, C7/C8, C9/C10, C11/C12, C13/C14, C15/C16, C15A/C16A, C17/C18, C19/C20, C21/C22, and C23/C24, as well as any subsequently developed connectors of a similar type.

Figure 2:
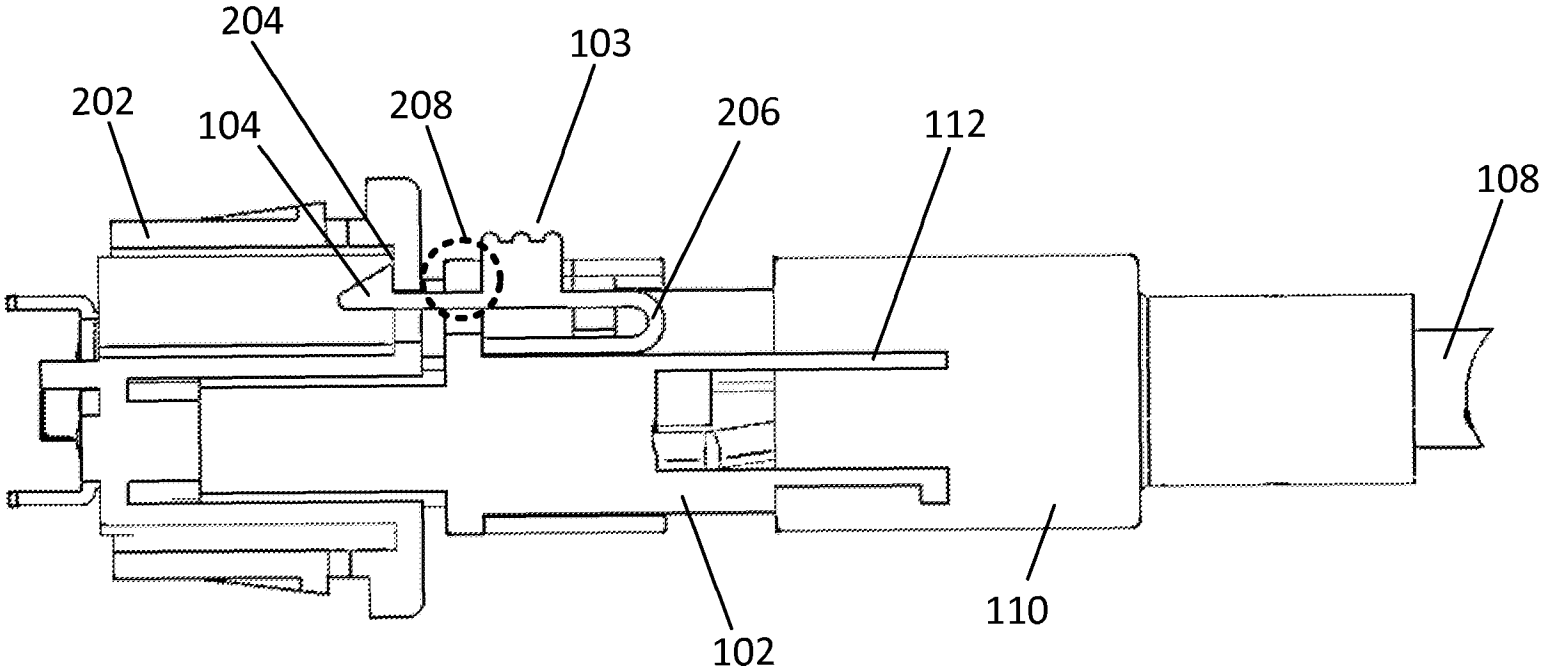
FIG. 2 is a cross-sectional view showing an electrical connector of the present disclosure inserted into an inlet with a first embodiment of a housing and sliding lock.

The C5 electrical connector 100 is comprised of a housing 102 over a portion of which the sliding lock 103, having locking tabs 104, is placed. An earth socket 106 and live/neutral sockets 107, attached to conductors 109 (or other power, signal, or data carrying devices) of cable 108, may then be inserted into the housing 102. An outer mold 110 may then be placed over an end portion 112 of the housing 102. FIG. 2 shows the C5 connector 100 in cross-section as inserted into a C6 inlet 202, with the sliding lock 103 engaged so that the locking tabs 104 may project into the inlet 202 and may engage an interior wall 204 of the inlet 202.

Figure 4A:
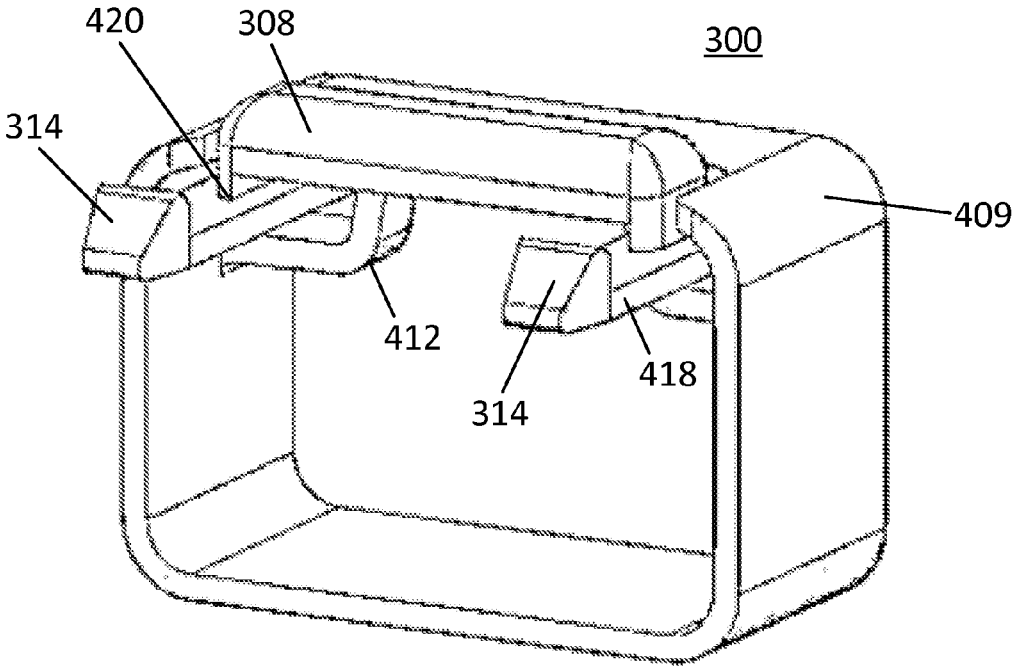
FIGS. 4A and 4B are perspective views showing the front and back, respectively, of the sliding lock of FIG. 3.
Figure 4B:
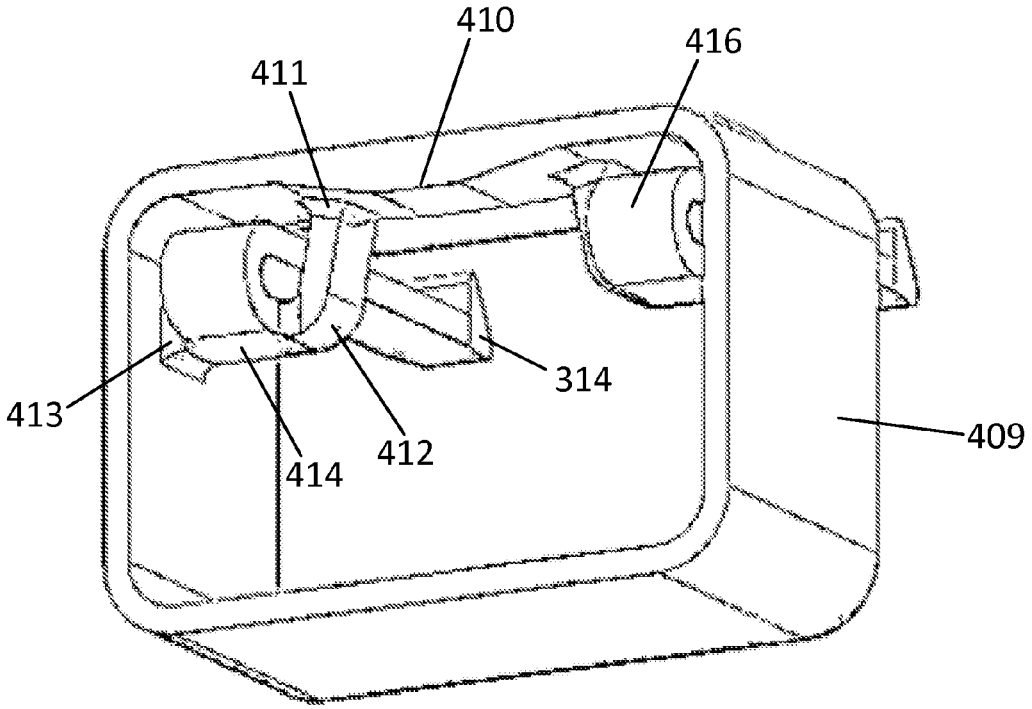

As shown in FIG. 2, and FIGS. 4A and 4B, the sliding lock 103 includes a type of flat, cantilevered spring arm 206 that may be affixed at its lower end and folded back around to create a deformable upper end terminated by the locking tabs 104. If the spring arm 206 is formed of a sufficiently deformable material, a side of the sliding lock 103 may be aligned quite close to the side of the housing 102, as illustrated by the first embodiment within the dashed circle 208, so that the spring arm is capable of substantially deforming in a vertical direction when pressure is applied by a user to a button on the top of the sliding lock.

Figure 3:
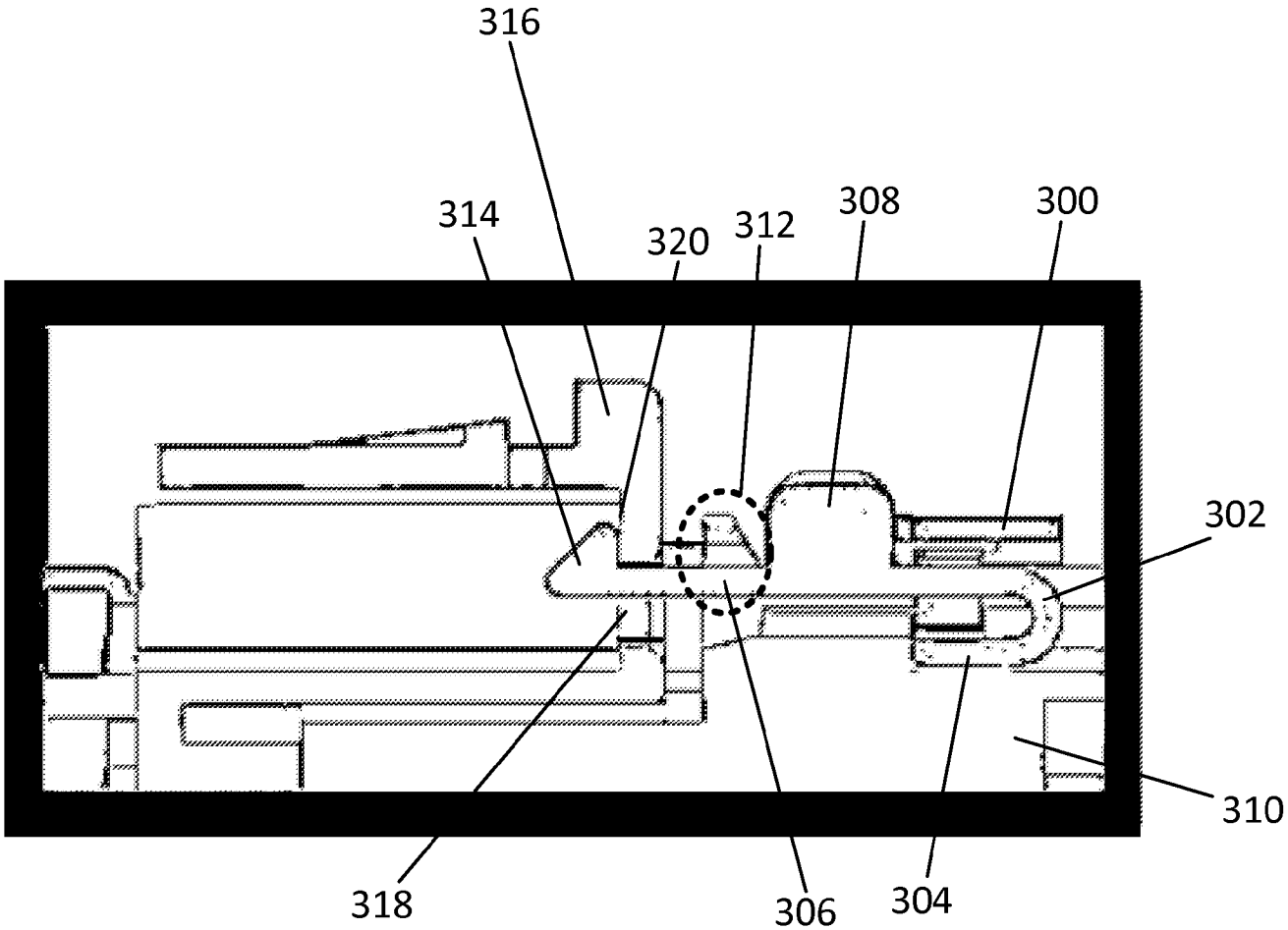
FIG. 3 is a cross-sectional view showing an electrical connector of the present disclosure inserted into an inlet with a second embodiment of a housing and sliding lock.

As it may be desirable to have a more resistant spring force for spring arm 206, a second embodiment is illustrated in FIG. 3. Sliding lock 300 includes spring arm 302, which may be a flat spring, affixed at a lower end 304 and folded back over itself, like spring arm 206. As illustrated in FIG. 3, spring arm 302 may have a shorter lower end 304 and a longer upper end 306. Affixed to upper end 306 of spring arms 302 may be button 308, which is more rounded than as shown in FIG. 2 so it is less likely to engage the housing 310 when depressed by a user. As illustrated within the dashed circle 312, the side of the housing 310 by the button 308 has also been angled to allow the button to tilt forward toward the housing 310 when depressed so the housing 310 does not resist the movement of the button 308. FIG. 3 also more fully illustrates the interaction between the upper end 306 of the spring arms 302, and its locking tabs 314, and the inlet 316. When the sliding lock 300 is engaged and moved forward toward the inlet 316, which has a hollow interior cavity, the locking tabs 314 of the spring arms 302 will enter the cavity of the inlet 316 through openings 318 far enough to enable the locking tabs to move upward and engage the interior wall 320 of the cavity, thereby locking the sliding lock 300 to the inlet 316.

Figure 4C:
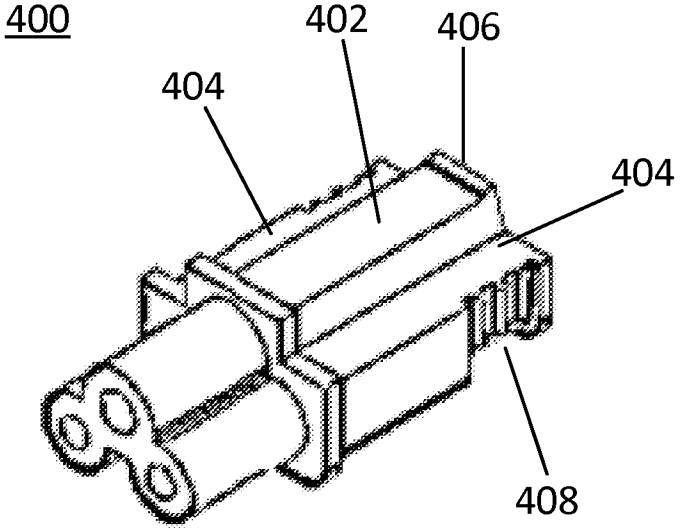
FIG. 4C is a perspective view of the housing of the present disclosure.

FIGS. 4A and 4B are perspective views showing the front and back, respectively, of the sliding lock 300 of FIG. 3 so as to provide a clearer understanding of how the sliding lock 300 may be constructed and interact with the housing 400 illustrated in FIG. 4C. The upper portion of the housing 400 may include a central raised portion 402 and two lowered side portions 404. The central raised portion 402 may include a lip 406 that acts as a stopper for sliding lock 300. The sliding lock 300 may be pushed over the end portion 408 of the housing and when the rear of the sliding lock 300 clears the lip 406, the lip 406 may stop and prevent the sliding lock 300 from sliding back off the housing 400. As noted in FIG. 4B, the upper rear portion of the lock housing 409 of the sliding lock 300 may thicken from front to back to form a lower projection 410 that may engage the lip 402. Alternately, the outer mold 110 may act as a stopper for the sliding lock 300. Supports 412 may also be attached to the lock housing 409 at points 411 on either side of the lower projection 410, so as to leave room for the central raised portion 402 of the housing 400 to move back and forth, and at points 413 on the sides of the lock housing 400. The lower ends 414 of the spring arms 416 extend to the back of the lock housing 409 from the supports 412 and along with the supports extend downward from the upper portion of the lock housing 409 so that supports 412 and spring arms 416 may move within the open areas created by the two lowered side portions 404 of the housing 400.

As further illustrated in FIGS. 4A and 4B, the spring arms 416 are folded back over themselves from the cantilevered points created by the supports 412 and form the upper portions 418 of the spring arms 416, thereby forming the spring of the spring arms 416. The button 308 of the sliding lock 300 is connected at points 420 to the upper portions 418 of both spring arms 416 so as to span the two and apply even pressure on both spring arms 300 when depressed by a user and to cause the locking tabs 314 to move toward the bottom of the lock housing 409. Button 308 may include one or more grooves or other projections to enable a user to securely engage the button 308 without unnecessary slippage.

Figure 5C:
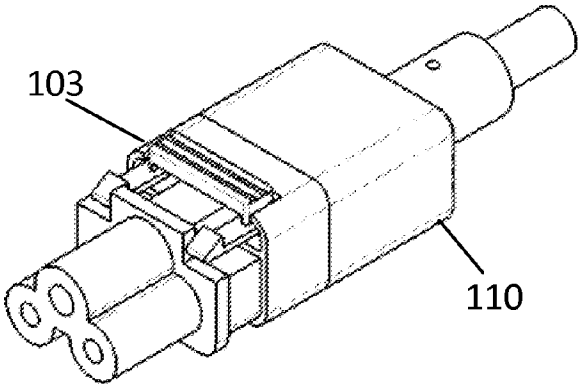
FIGS. 5A, 5B, 5C and 5D are a collection of views showing an electrical connector of the present disclosure when the sliding lock is disengaged.
Figure 5D:
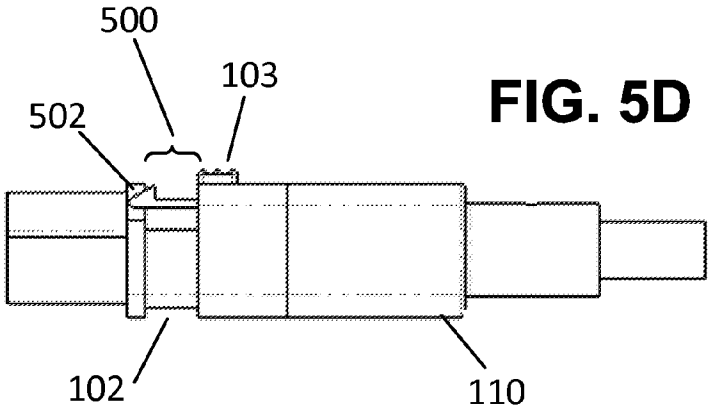
Figure 5A:
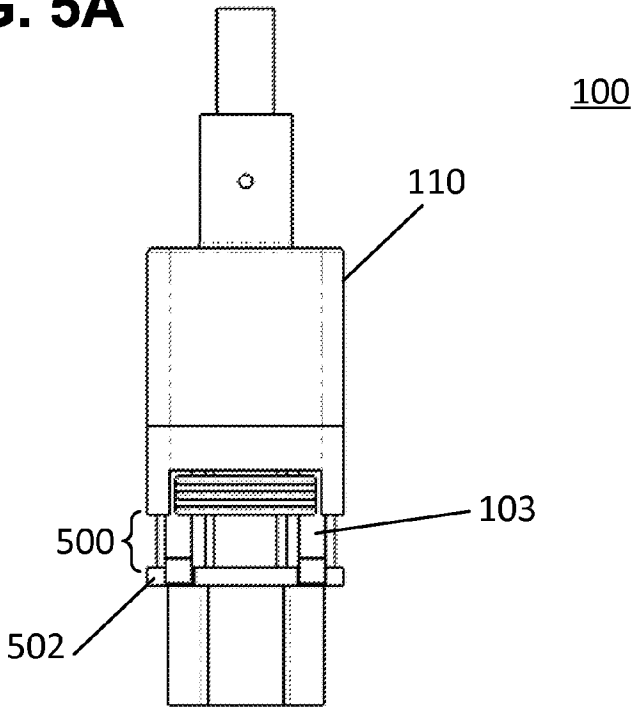
Figure 5B:
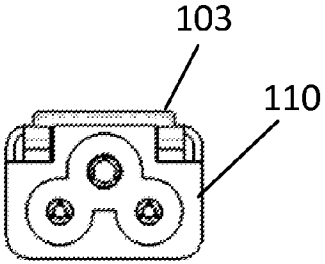
Figure 6C:
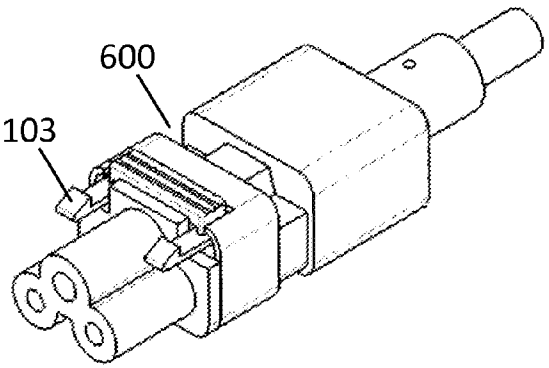
FIGS. 6A, 6B, 6C and 6D are a collection of views showing an electrical connector of the present disclosure when the sliding lock is engaged.
Figure 6D:
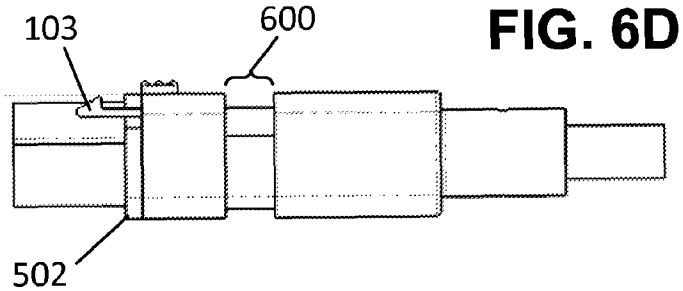
Figure 6A:
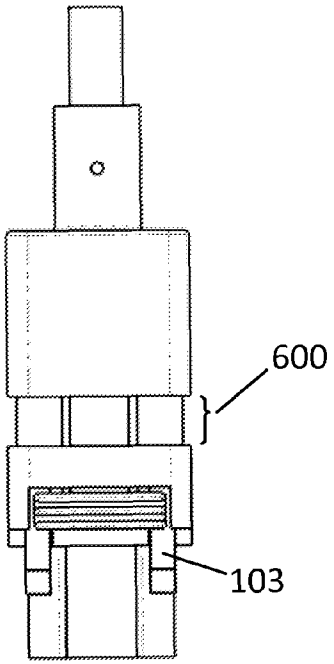
Figure 6B:
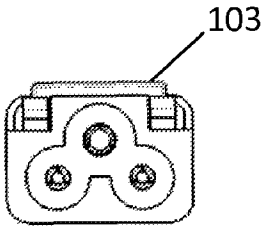
Figure 7:
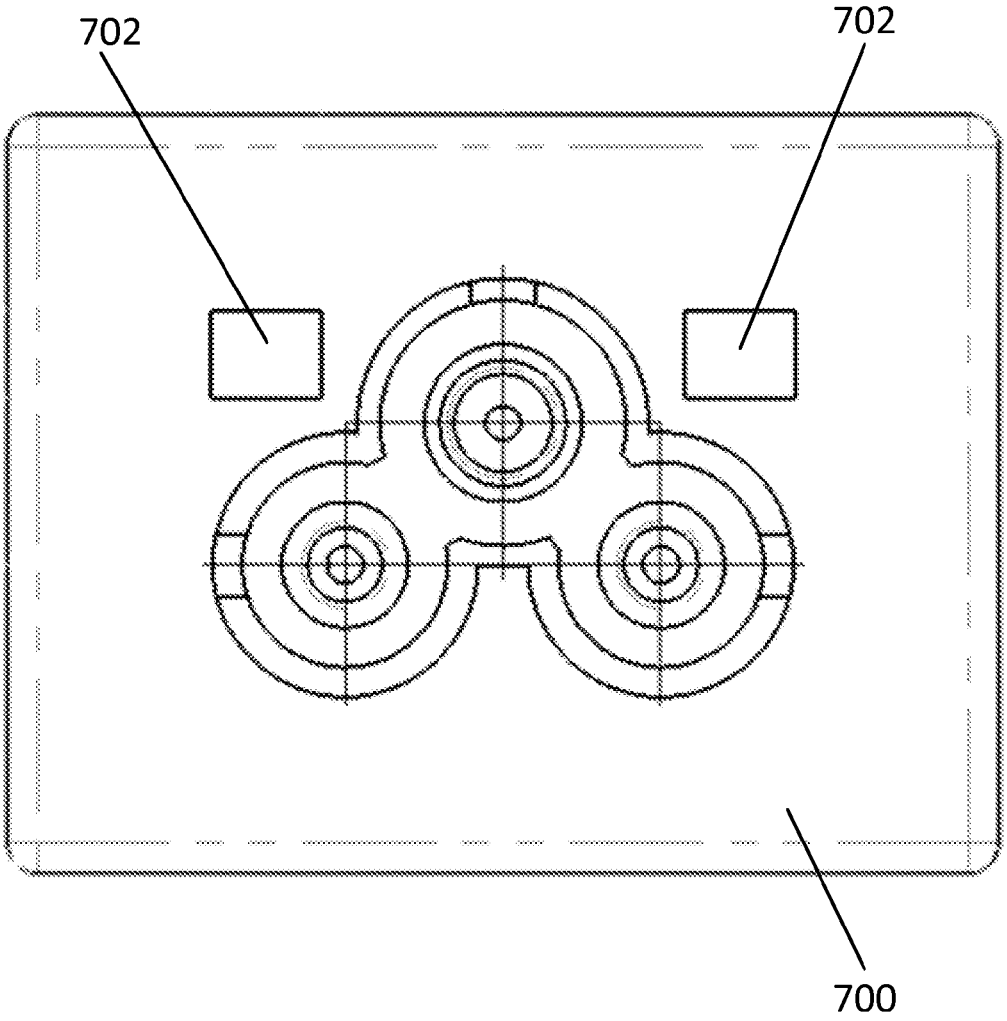
FIG. 7 is a front side view of an inlet for engaging an electrical connector of the present disclosure.

FIGS. 5A-5D are a collection of views of the electrical connector 100 when the sliding lock is disengaged. FIG. 5A shows a top plan view of the electrical connector 100, FIG. 5B shows a front side view of the electrical connector 100, FIG. 5C shows a perspective view of the electrical connector 100, and FIG. 5D shows a side view of the electrical connector 100 when the sliding lock 103 is pulled back toward the outer mold 110 in a disengaged position. The sliding lock 103 moves back and forth over the housing 102 within a gap 500 formed between the outer mold 110 (or a point close to it) and an end 502 of the housing 102. FIGS. 6A-6D are a collection of views of the electrical connector 100 when the sliding lock is engaged. As illustrated, the sliding lock 103 is now moved up toward the end 502 of the housing 102 eliminating gap 500, and creating gap 600 at the back of the sliding lock 103. Hence, sliding lock 103 moves back and forth within the gaps 500 and 600 to engage and disengage the inlet 700 as shown in the front side view of FIG. 7. Inlet 700 includes two openings 702, as described above with regard to openings 318 of inlet 316, through which the locking tabs 104 of the sliding lock 103 project to engage the interior wall of the inlet and lock the sliding lock 103 in place.

Figure 8A:
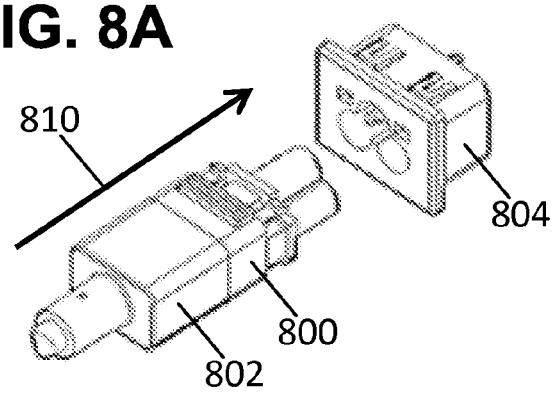
FIGS. 8A, 8B and 8C are a collection of perspective views showing a sliding lock and an electrical connector of the present disclosure engaging an inlet.
Figure 8B:
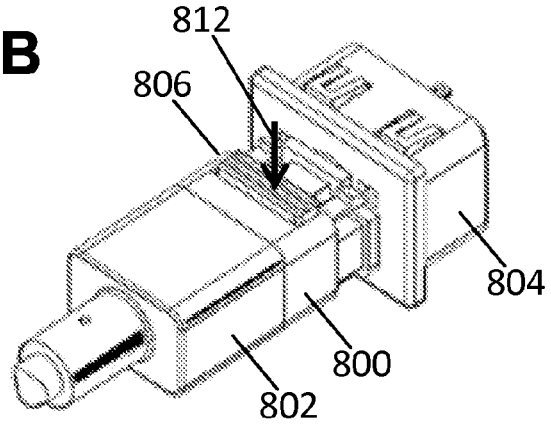
Figure 8C:
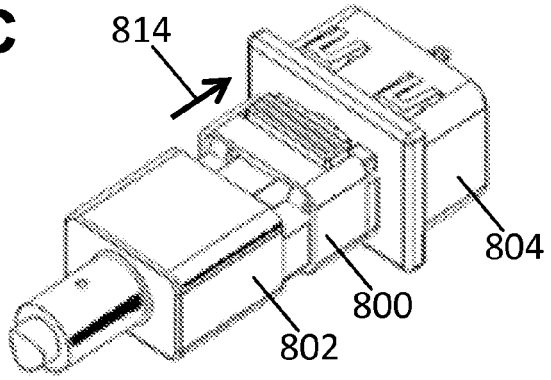
Figure 9A:
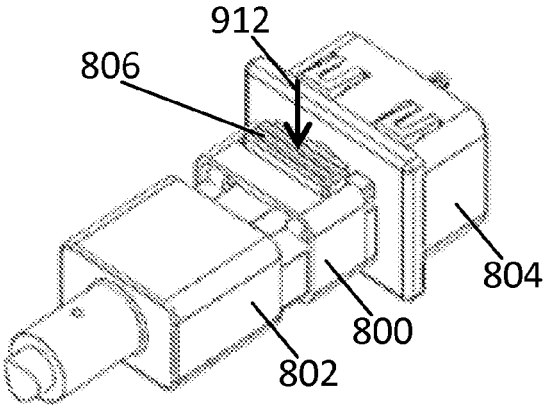
FIGS. 9A, 9B and 9C are a collection of perspective views showing a sliding lock and an electrical connector of the present disclosure disengaging an inlet.
Figure 9B:
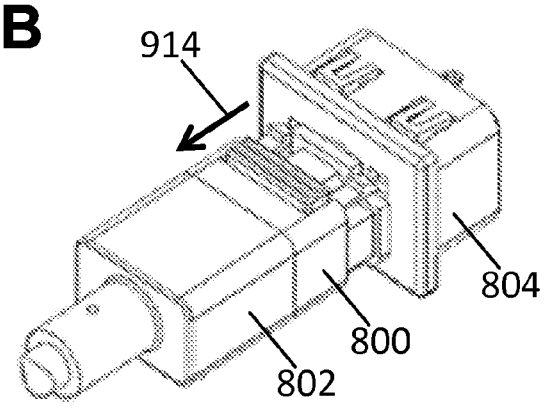
Figure 9C:
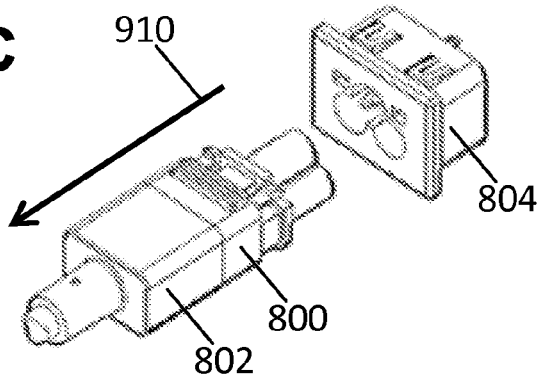

FIGS. 8A-8C are a collection of perspective views showing a sliding lock 800 of an electrical connector 802 engaging an inlet 804 and FIGS. 9A-9C are a collection of perspective views showing the sliding lock 800 of electrical connector 802 disengaging the inlet 804. In FIG. 8A the connector 802 is aligned with the inlet 804 with the sliding lock 800 slid back to its disengaged position. To transition from FIG. 8A to FIG. 8B, the connector 802 is moved along direction 810 while remaining aligned with inlet 804 to insert the connector 802 into the inlet 804. FIG. 8B depicts the connector 802 inserted into the inlet 804, with the sliding lock 800 in the disengaged (unlocked) position. To engage the sliding lock 800 and transition from FIG. 8B to FIG. 8C, the sliding lock 800 is pushed forward along direction 814 toward the inlet and over connector 802. In FIG. 8C, the locking tabs of the sliding lock 800 will enter the openings of the inlet 804 and the user will continue to push the sliding lock 800 forward until the two locking tabs snap into their locked position inside the inlet 804. The raised rectangular button 806 can be pressed down in direction 812 to aid the bending of the locking tabs as they enter the openings of the inlet 804. In FIG. 9A, the user presses down in direction 912 on the raised rectangular button 806 to disengage the locking tabs from the interior wall of the inlet 804. In FIG. 8B, the user slides the sliding lock 800 away from the inlet 804 in direction 914, and in FIG. 9C, pulls the connector 802 away from the inlet 804 along direction 910.

Although embodiments of the present disclosure have been illustrated in conjunction with the accompanying drawings and described in the foregoing detailed description, it should be appreciated that the invention is not limited to the embodiments disclosed and is capable of numerous rearrangements, modifications, alternatives, and substitutions without departing from the spirit of the disclosure as set forth and recited by the following claims.

What is claimed:

1. A connector, comprising:

a housing configured to affix individual lines of a multiline cable within the housing, the housing including a front portion including a raised central insertion area and at least one lowered side insertion area for engaging an inlet, a rear portion, and an upper portion including a raised central area and at least one lowered side area;

a sliding lock including a lock housing configured to slide over the raised central area and the at least one lowered side area, and including at least one spring arm affixed to the lock housing, and wherein, when the sliding lock is slid forward, a portion of the at least one spring arm is above the at least one lowered side insertion area and beside the raised central insertion area, and the bottom of the portion of the at least one spring arm is below the top of the raised central insertion area; and a stopper at the rear portion of the housing and configured to constrain the sliding lock within a gap formed between a forward portion of the housing and the stopper, wherein the sliding lock is configured to slide forward within the gap to engage the inlet and lock the sliding lock in place, thereby locking the connector to the inlet, and slide backward within the gap and disengage the inlet.

2. The connector of claim 1, wherein the at least one spring arm is affixed at one end to the lock housing and folded back approximately 180 degrees to form a cantilevered spring, and wherein the at least one spring arm includes a locking tab at another end for engaging the inlet.

3. The connector of claim 2, wherein the sliding lock includes a button configured to engage the at least one spring arm and depress the at least one spring arm for engagement and disengagement with the inlet.

4. The connector of claim 3, wherein the locking tab engages an interior wall of the inlet to hold the locking tab in place when the connector is fully inserted into the inlet and the button depressing the at least one spring arm is released.

5. The connector of claim 3, wherein the locking tab engages an interior wall of the inlet to hold the locking tab in place until the button is depressed sufficiently to cause the locking tab to disengage the interior wall and either the sliding lock is slid backward within the gap, or the connector is removed from the inlet.

6. The connector of claim 3, wherein the locking tab engages an interior wall of the inlet to hold the locking tabs in place when the connector is fully inserted into the inlet and the button depressing the at least one spring arm is released, and wherein the locking tab engages the interior wall of the inlet to hold the locking tab in place until the button is depressed sufficiently to cause the locking tab to disengage the interior wall and the sliding lock is removed from the inlet.

7. The connector of claim 2, wherein the locking tab engages an interior wall of the inlet to hold the locking tab in place.

8. The connector of claim 1, wherein the lock housing completely surrounds the housing and wherein the at least one spring arm is positioned within the at least one lowered side area.

9. The connector of claim 1, wherein the stopper is a lip on the housing.

10. The connector of claim 1, wherein the stopper is an outer mold configured to engage the rear portion of the housing.

11. A coupler, comprising:

a housing configured to affix individual lines of a multiline cable within the housing, the housing including a front portion including a raised central insertion area and at least one lowered side insertion area for engaging an inlet, a rear portion, and an upper portion including a raised central area and at least one lowered side area;

a sliding lock including a lock housing configured to slide over the raised central area and the at least one lowered side area and at least one spring arm affixed to the lock housing, and wherein, when the sliding lock is slid forward, a portion of the at least one spring arm is above the at least one lowered side insertion area and beside the raised central insertion area, and the bottom of the portion of the at least one spring arm is below the top of the raised central insertion area; and an outer mold configured to engage the rear portion of the housing and constrain the sliding lock within a gap formed between the housing and the outer mold; and wherein the inlet includes an inlet housing having a front face and forming an interior cavity behind the front face, the interior cavity forming an interior wall within the interior cavity, wherein the inlet housing further forms at least one opening within the front face for receiving the at least one spring arm, wherein the sliding lock is configured to slide forward within the gap to engage the opening of the inlet and lock the sliding lock in place, thereby locking the housing to the inlet, and slide backward within the gap and disengage the inlet.

12. The coupler as recited in claim 11, wherein the coupler is a coupler defined by the International Electrotechnical Commission 60320 standard.

13. The coupler of claim 11, wherein the at least one spring arm is affixed at one end to the lock housing and folded back to form a cantilevered spring, and wherein the at least one spring arm includes a locking tab at another end for engaging the inlet.

14. The coupler as recited in claim 13, wherein the at least one spring arm includes a button configured to engage the at least one spring arm and depress the at least one spring arm for engagement and disengagement with the inlet.

* * * * *